US007146238B2

(12) United States Patent
Burma

(10) Patent No.: US 7,146,238 B2
(45) Date of Patent: Dec. 5, 2006

(54) METHOD FOR CONTROLLING ONE OR MORE PROPERTIES OF A SHEET OF MATERIAL

(75) Inventor: Gary K. Burma, West Vancouver (CA)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/307,499

(22) Filed: Feb. 9, 2006

(65) Prior Publication Data

US 2006/0111808 A1 May 25, 2006

Related U.S. Application Data

(62) Division of application No. 10/608,467, filed on Jun. 25, 2003.

(51) Int. Cl.
*G00F 7/66* (2006.01)

(52) U.S. Cl. ..... 700/127; 162/252

(58) Field of Classification Search ..... 700/127–129; 73/159; 162/198, 252, 238; 702/33, 104
See application file for complete search history.

(56) References Cited

U.S. PATENT DOCUMENTS

| | | | | |
|---|---|---|---|---|
| 4,786,529 | A | 11/1988 | Boissevain | |
| 5,752,324 | A | 5/1998 | Muller et al. | |
| 5,827,399 | A * | 10/1998 | Neittaanmaki et al. | 162/198 |
| 6,162,331 | A * | 12/2000 | Ruf et al. | 162/198 |
| 6,168,687 | B1 * | 1/2001 | Hu et al. | 162/198 |
| 6,200,422 | B1 * | 3/2001 | Shakespeare et al. | 162/198 |

FOREIGN PATENT DOCUMENTS

WO WO 02/42555 A1 5/2002

* cited by examiner

*Primary Examiner*—Albert W. Paladini
(74) *Attorney, Agent, or Firm*—Narendra R. Thappeta

(57) ABSTRACT

A method and system for controlling one or more properties of a sheet of material to be manufactured on a sheet-making machine is disclosed. Actuators to control the sheet properties are arrayed in the cross-direction of the machine. Properties data about one or more properties of the sheet of material are measured and both the magnitude of an actuator control action and the cross-direction shape of an actuator control action are controlled to minimize the variation of the measured properties data from a desired target for each of the one or more properties.

21 Claims, 10 Drawing Sheets

METHOD FOR CONTROLLING ONE OR MORE PROPERTIES OF A SHEET OF MATERIAL

RELATED APPLICATION

The present application is a divisional application of and claims priority from co-pending U.S. patent application Ser. No. 10/608,467, filed: Jun. 25, 2003, entitled, "Cross-direction actuator and control system with adaptive footprint", and is incorporated in its entirety herewith.

FIELD OF THE INVENTION

This invention relates to a control method and system for use with sheet-making equipment.

BACKGROUND OF THE INVENTION

Conventional sheet-making machinery for producing a continuous web or sheet of material includes equipment to set the sheet properties of the web as it is being manufactured. Generally, on-line measurements of sheet properties are made by scanning sensors that travel back and forth across the width of the sheet of material in the cross-machine direction (CD). The machine direction (MD) is the direction of travel of sheet. The scanning sensors are located downstream of actuators that are controlled to adjust the sheet properties. The scanning sensors collect information about the sheet properties to develop a property profile across the sheet and provide control signals to the appropriate actuators to adjust the profile toward a desired target profile in a feedback loop. In practice, the actuators provide generally independent adjustment at adjacent cross-directional locations of the sheet, normally referred to as slices.

In paper-making equipment, properties such as paper weight, thickness (caliper), smoothness, moisture content, and gloss are controlled by manipulating appropriate actuators to adjust the properties under the actuators' influence toward a desired goal.

High-performance cross-directional (CD) control of sheet-making machines, particularly, paper machines, requires accurate knowledge of the controlled process model. Particularly important for CD control is an accurate knowledge of the mapping between CD actuators and their response centre positions in the measurement scan. Mapping involves establishing the relationship between each downstream slice where scanning measurements occur and the corresponding upstream actuator that must be adjusted to control the particular downstream slice. In practice, this mapping depends on the paper alignment and shrinkage, which vary from one paper machine to another and with time for the same machine.

Even though mapping is used, conventional control systems still rely on actuators that have a fixed footprint that affects a particular slice of the sheet under manufacture. Only the magnitude of the actuator response is manipulated by conventional control systems to adjust sheet properties and there is no attempt to dynamically manipulate response shape. In some cases, the actuator footprint shape may change but this change is not controlled directly and is a consequence of manipulation of the magnitude of the actuator response.

SUMMARY OF THE INVENTION

The method and system of the present invention involves:

the use of an actuator that has 2 control dimensions: the magnitude of the actuator control action and the cross-direction footprint or shape of the actuator control action.

the use of a controller that takes into account the measured process response from the actuator. The controller then calculates the best footprint or shape to minimize profile variation and then inputs this optimal response shape and magnitude to the actuator on an ongoing basis.

Accordingly, the present invention provides a method for controlling one or more properties of a sheet of material to be manufactured on a sheet-making machine that includes actuators to control the sheet properties arrayed in a cross-direction of the machine comprising the steps of:

measuring properties data about the one or more properties of the sheet of material; and controlling both the magnitude of an actuator control action and the cross-direction shape of an actuator control action to minimize the variation of the measured properties data from a desired target for each of the one or more properties.

In a further aspect, the present invention provides a system for controlling one or more properties of a sheet of material to be manufactured on a sheet-making machine comprising:

a plurality of actuators distributed in the cross-machine direction over the sheet of material that are controllable to vary the properties of the sheet of material by varying both the magnitude of the actuator response and the cross-directional shape of the actuator response;

scanners distributed over the sheet of material to measure properties data about the properties of the sheet of material;

a controller in communication with the scanners for calculating control actions for each of the plurality of actuators and implementing appropriate control actions at the actuators such that the actuators co-operate to adjust the properties of the sheet of material to desired targets.

The controller of the present invention takes into account the flat sheet process response of the material under manufacture and manipulates the two dimensions of the actuator control to optimize the manufacturing process. Both actuator characteristics and flat-sheet process characteristics are taken into account when calculating control actions.

By directly controlling two dimensions of the actuator response via control actions to adjust both magnitude and footprint shape, the process and apparatus of the present invention offers improved control over the manufacturing process. Without footprint shape control, there may be variation in the cross-direction in the sheet property being controlled that cannot be eliminated by adjusting only the magnitude of the actuator response. By optimizing the actuator footprint shape as well as magnitude, the controller for the system of the present invention can further reduce variation in the sheet properties to better achieve a desired target property.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

The method and system of the present invention finds application at various stages of the sheet-making process from the initial paper forming and weight control step through the pressing, drying, and calendaring stages. It will be understood that the method and system of the present invention are not limited to use in association with any one stage or process. The method of the present invention can be used in conjunction with various types of actuators to control properties of a sheet under manufacture including, but not limited to, sheet weight, sheet caliper or thickness, sheet moisture content, and sheet gloss. The following description provides specific examples of the manner in which the method of the present invention can be carried out to control two dimensions of actuator response: i) the magnitude of the actuator control action; and ii) the cross-direction footprint or shape of the actuator control action.

Figure 1:
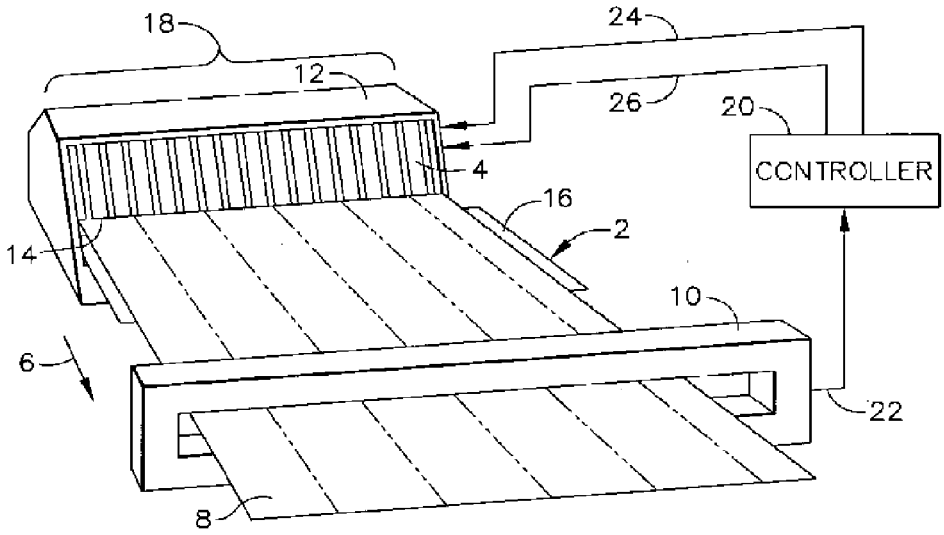
FIG. 1 is a schematic view of a paper-forming section of sheet-making equipment according to the present invention that relies on a slice lip to control the weight of the paper sheet under manufacture.

Referring to FIG. 1, there is shown a schematic view of the initial section of a sheet-making machine 2, in the form of a paper-making machine, which operates to form the sheet of paper and establish the weight of the sheet. In the illustrated arrangement, formation of the paper sheet is influenced by a plurality of linear actuators 4 extending in the cross direction across the sheet 8 of paper being formed. Sheet 8 is moving in the machine direction indicated by arrow 6. The general arrangement of FIG. 1 is described in commonly owned U.S. Pat. No. 5,096,542, which is incorporated herein by reference.

Figure 1A:
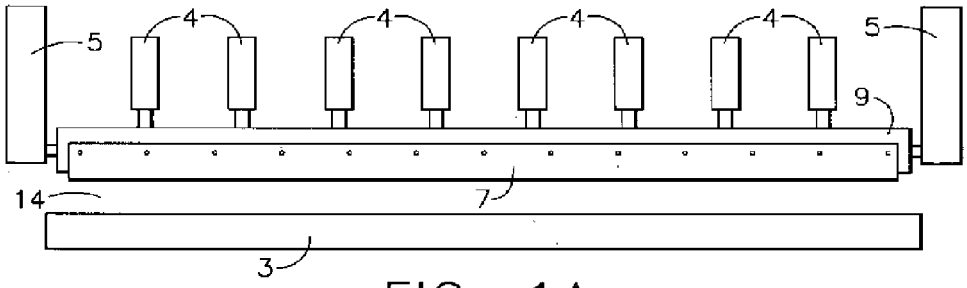
FIG. 1A is a detail view of the slice lip of the paper-forming section shown in FIG. 1.

Actuators 4 control the sheet's weight in the cross direction. A sensor 10 is located downstream from the actuators and measures the properties of the sheet. A head box 12 stores stock, which is essentially a fibre suspension. The stock is fed from the head box through a gap or elongate orifice 14 onto a wire section 16. The orifice or gap is a relatively narrow opening that extends across the width 18 of the machine. As best shown in FIG. 1A, which is a detail view of the slice lip arrangement of FIG. 1, the major components that make up the orifice comprise a bottom section, referred to as the apron 3, and a top section, referred to as the slice lip 7. Weight profile control in such an arrangement is achieved by locally adjusting the position of the slice lip across the machine with motorized linear actuators 4 to vary the dimensions of the gap or orifice immediately adjacent the actuator. Upper slice lip 7 is mounted to a bar 9 that is movable, often by pivoting, using additional actuators 5 to globally adjust the slice lip and thereby the orifice in the cross machine direction.

Referring to FIG. 1, downstream sensor 10 measures the weight of the sheet by, for example, scanning across the sheet in a conventional manner. In general, a specialized sensor in the form of a scanner will be located downstream of the actuators of interest to measure the relevant sheet property controlled by the actuators. In other words, a plurality of scanners is located along the path of the sheet under manufacture after each set of actuators to provide measured data relevant to the property controlled by actuators. Alternatively, a sensor can be used to measure and collect data on multiple properties in one or more scanning passes.

Measured data from sensor 10 is communication to a controller 20 via line 22. In the illustrated arrangement, controller 20 is associated only with the set of actuators 4 and 5 that control the weight of the paper. Alternatively, controller 20 can be an overall control unit that receives measurement data from various scanning stations and provides actuator control actions to different sets of actuators controlling particular sheet properties.

In the arrangement illustrated in FIGS. 1 and 1A, controller 20 calculates control actions to communicate to each of the actuators 4, 5 in order to minimize the variation of the measured properties data from a desired target. Controller 10 calculates a first control action in order to vary the magnitude of the actuator response and a second control action to vary the cross-directional shape of the actuator response. For example, the first control action may involve a signal to each linear actuator 4 to locally adjust the gap 14 between slice lip 7 and apron 3. Each actuator includes a threaded shaft connected at one end to bar 9 and at the opposite end to a motor to rotate the shaft. In this case, the first control action would be a signal to the motor to rotate the shaft to locally lower or raise the slice lip. The second control action would be a signal to actuators 5 to globally adjust the dimensions of orifice 14.

In the present-case, the first and second control actions calculated by controller 20 are communicated to each actuator as first and second setpoints via lines 24, 26. The process of measuring sheet properties data by scanner is performed at regular intervals to provide feedback to the controller with respect to previous control actions. When calculating the first and second control actions, controller 20 is programmed to take into account the characteristics of the actuator being controlled. In a similar manner, controller 20 is programmed to take into account the characteristics of the sheet being manufactured.

Figure 1B:
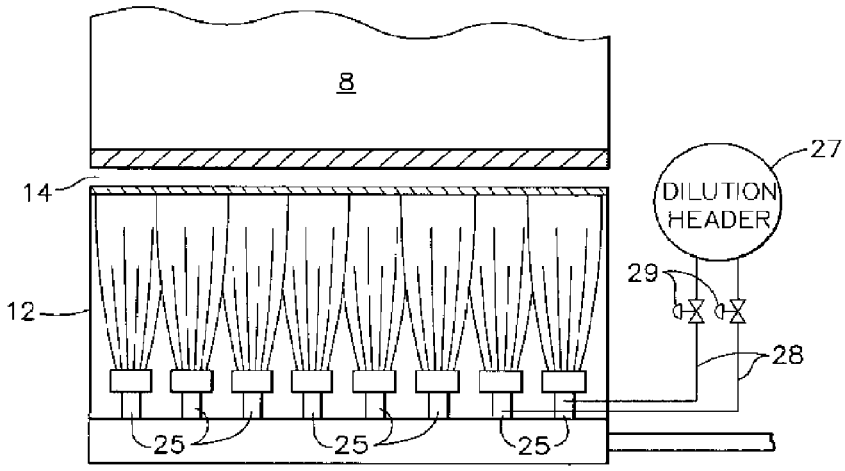
FIG. 1B is a detail schematic view in plan of an alternative head box arrangement that relies on dilution water to control the weight of the paper sheet under manufacture.

FIG. 1B shows a different head box arrangement, which relies on dilution of the stock to influence the weight of the paper sheet being manufactured. FIG. 1B is a plan view of the head box 12 with a sheet 8 being formed at the slice lip gap 14. At the end of the head box opposite the slice lip gap, there are a plurality of stock flow actuators 25 arrayed across the head box in the cross-machine direction that distribute stock from a header fed by a stock source (not shown). Dilution water from a dilution header 27 is controllably injected into each stock flow actuator 25 via dilution lines 28. For reasons of clarity, only two dilution lines 28 are illustrated. It will be appreciated that each stock flow actuator 25 has an associated dilution line 28. Under normal practice, stock flow actuators 25 include a restriction to limit flow. Preferably, in the embodiment of the present invention, each line 28 includes a valve 29 to control the flow of dilution water. In this arrangement, the first control action to vary the magnitude of the control response comprises individual adjustment via conventional actuators at each valve 29 to control the volume of dilution water 5 through each actuator. The second control action to vary the footprint of the control response at each actuator involves controlling the pressure of injection of the dilution water delivered to each stock flow actuator 25. Controlling the pressure of injection of the dilution water controls the degree of mixing of the stock in the head box, which tends to change the apparent consistency profile of the stock. Global 10 adjustment of the pressure of the dilution water is achievable by changing the pressure in dilution header 27 relative to pressure of stock in actuators 25. Individual adjustment of the pressure to a particular stock flow actuator 25 is achieved by controlling an actuator in the form of a pump or regulator in each line 28.

By way of further example, the method and system of the present invention finds application in other aspects of the paper-making process apart from the initial establishment of the paper basis weight.

Figure 2:
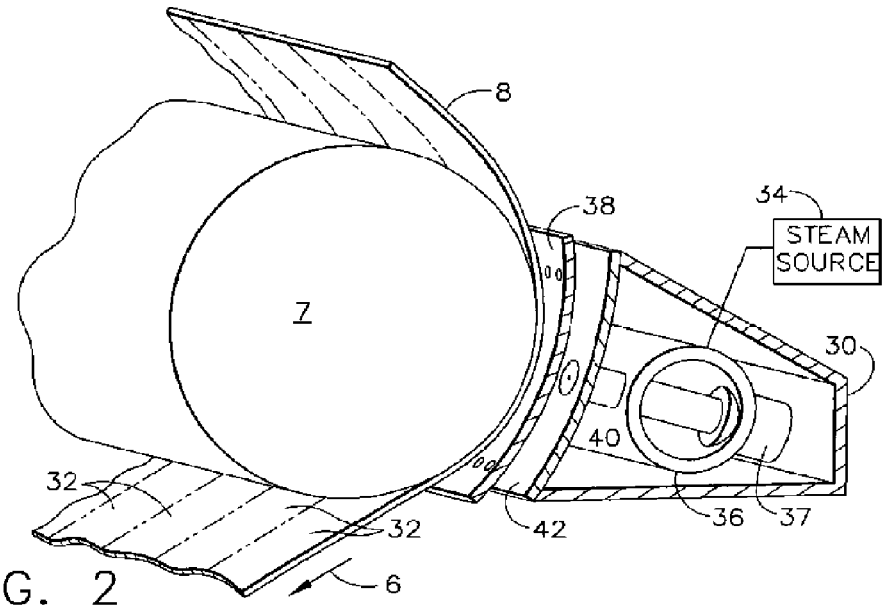
FIG. 2 is a schematic view of a steam box arrangement incorporating the system and process of the present invention.

In the case of the press and calendaring sections of a paper-making machine, 20 steam may be added to the paper sheet under manufacture by a steam box. The steam condenses on the sheet to release its thermal energy to the sheet. The present invention finds application in a modified steam box arrangement. Referring to FIG. 2, there is shown schematically a view of a steam box 30, which extends in the cross-machine direction adjacent sheet 8, which is traveling in the direction 25 indicated by arrow 6 under the influence of a rotating roll 7. Each steam box 30 defines a plurality of control zone 32 or "slices" of sheet 8 within which the steam box is able to control the delivery of steam to the sheet. As in conventional steam box equipment, a source of steam 34 delivers steam to steam box 30 via a steam supply manifold 36 that extends in the cross-machine direction. A sensor (not shown) regularly measures the moisture content of the sheet in the cross-direction at a location downstream of the steam boxes. The measured moisture content sheet property data is then fed to the controller of the present invention. The controller determines how the measured moisture profile of the sheet 8 needs to be adjusted to move the actual profile toward a target profile and generates appropriate control actions. As with conventional systems, the volume of steam flow to each control slice 32 is varied to control the magnitude of the control action at a particular cross direction location. Steam box 30 is formed with a plurality of steam outlet chambers for releasing steam to each control slice of the sheet of material. In the present invention, the steam outlet chambers are also manipulatable in terms of outlet chamber position and dimensions to control the cross-direction shape of the control action and, thereby, the shape of each control zone 32.

Figure 3B:
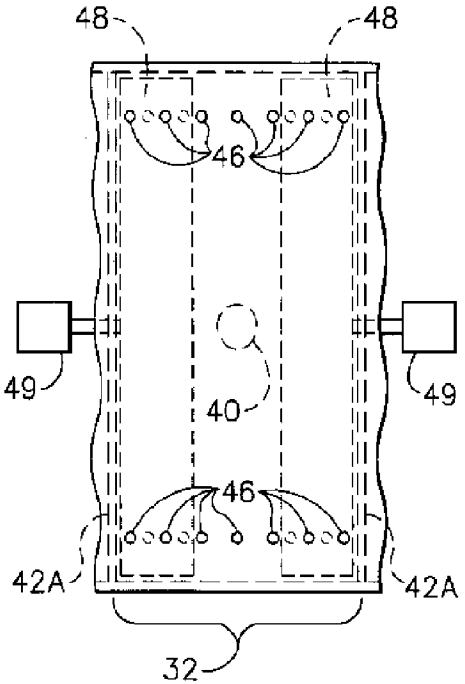
FIG. 3B is a further detail view of a portion of the steam box screen showing a further embodiment, which relies on a movable screen to control the shape of a steam actuator footprint.

A screen 38 at the front of the steam box delivers steam from steam box 30 to condense on the sheet under manufacture to release the steam's thermal energy to the sheet. A plurality of conventional steam nozzles 40 to the rear of steam box 30 receive steam via manifold 36. Each steam nozzle 40 defines a control slice 32 of the steam box 30. Associated with each steam nozzle is an actuator 37 and an outlet chamber 42 just behind screen 38. Each actuator 37 adjusts the volume of steam flow to its associated steam nozzle 40 and thereby to associated outlet chamber 42 just behind screen 38. FIG. 3 shows a partial front view looking at a portion of screen 38 according to an embodiment of the present invention. In this arrangement, outlet chamber 42 behind screen 38 includes movable baffle plates 42B that are movable between spaced, outer walls 42A of the outlet chamber to adjust the position and size of the outlet chamber about centrally-located steam nozzle 40. An actuator motor 44 working through an appropriate mechanical linkage 44A is used to manipulate the cross-direction position of baffle plates 42B and thereby the position and dimensions of the outlet chamber. In FIG. 3, baffle plates 42B are shown spaced away from outer side walls 42A of the outlet chamber and closer to central steam nozzle 40 to create a smaller footprint for control slice 32. Baffle plates 42B can also be moved adjacent outer side walls 42A to maximize the size of outlet chamber 42 and control slice 32.

Figure 3A:
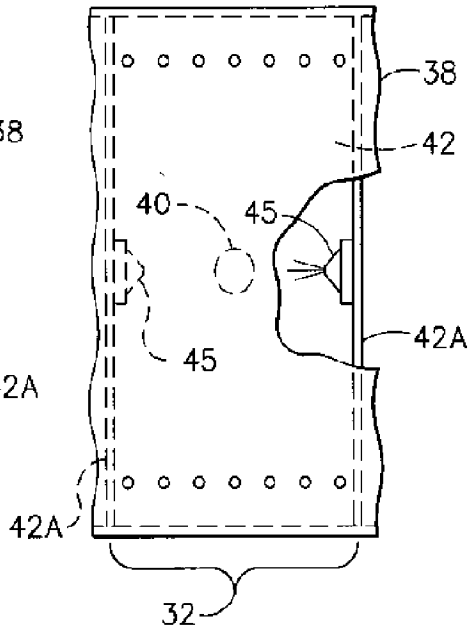
FIG. 3A is a detail view of a portion of the steam box screen showing an alternative embodiment that uses air jets for controlling the shape of a steam actuator footprint.
Figure 3:
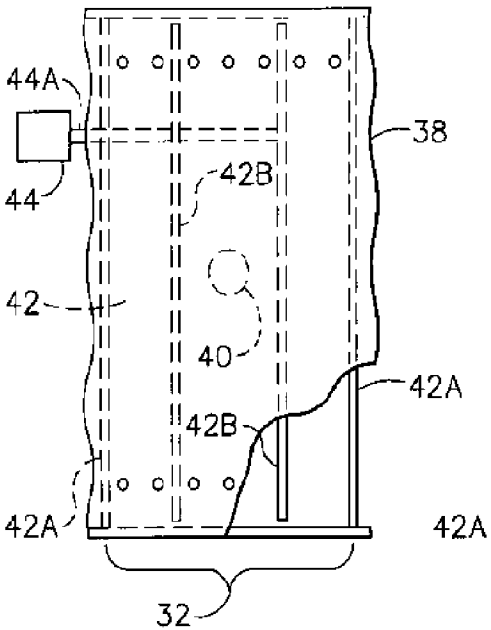
FIG. 3 is a front view of a portion of the steam box arrangement of FIG. 2 showing an embodiment that relies on movable baffle plates to control the shape of a steam actuator footprint.

In an alternative arrangement illustrated in FIG. 3A, each outlet chamber 42 includes at least one air jets 45. In FIG. 3A, two air jets are shown mounted to opposite side walls 42A of the outlet chamber, however, other arrangements are possible and would be obvious to a person skilled in the art. Air jets 45 are discharged to control the dispersal pattern of the steam through the openings in screen 38. Varying the air flow volume or pressure will permit control of the dispersal pattern of steam from each outlet chamber with a resulting controlled change in the footprint of actuator. For example, no air flow through air jets 45 will allow steam from nozzle 40 to disperse fully within outlet chamber 42 and the control slice 32 will attain a maximum size. By discharging air through jets 45, the steam will tend to be compressed into a smaller footprint.

FIG. 3B shows a still further alternative arrangement for controlling the shape of the steam actuator footprint. FIG. 3B is also a detail view of a portion of the front of screen 38. Screen 38 covering outlet chamber 42 includes a plurality of openings 46 therethrough to allow for passage of steam from the chamber to the sheet. At least one movable plate 48 is positioned below screen 38 within outlet chamber 42. In the illustrated embodiment, two movable plates 48 (in dashed lines) are shown adjacent each outer side wall 42A of the outlet chamber below screen 38. In this case, the step of manipulating the cross-direction shape of the actuator control action involves adjusting the position of movable plates 48 with respect to screen 38 to fully or partially obstruct the openings 46 in the screen 38 to control the release of steam through those openings. Movable plates 48 are preferably formed with their own openings that are alignable or misalignable with openings 46 in screen 38. Preferably, each movable plate 48 is controlled by a motor 49 that acts to move plate 48 between the position shown in FIG. 3B, in which the openings in the screen and the plates are aligned for control footprint of maximum size, and other positions, in which the openings are partially or fully misaligned to reduce the footprint of the steam actuator.

Figure 4:
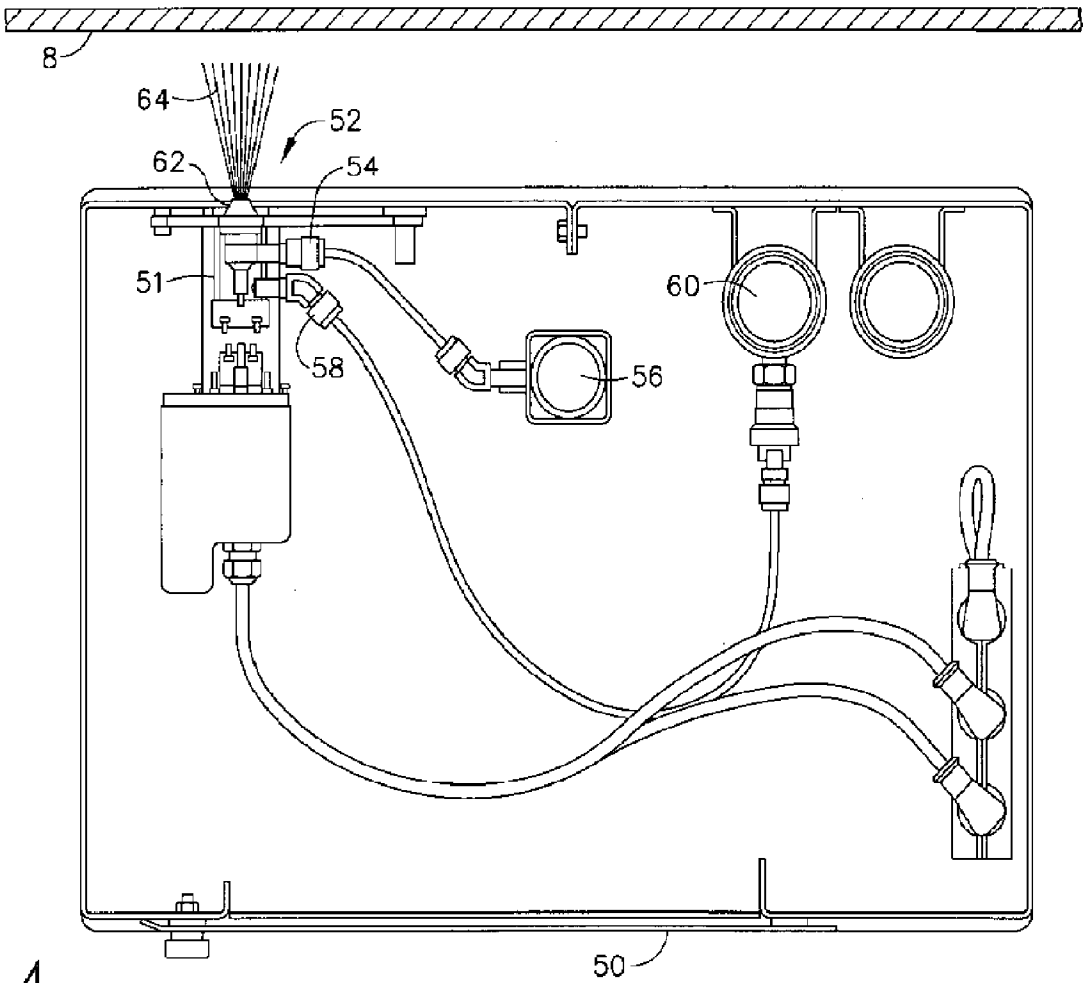
FIG. 4 is a schematic view of a water spray remoisturizer actuator for use with the present invention.

Moisture can be added to a paper sheet by nozzle actuators, which spray water atomized by air pressure onto the sheet. By way of example, commonly owned U.S. Pat. No. 6,334,579, entitled AIR ATOMIZING NOZZLE, discloses an example of such a nozzle assembly which is sold under the trademark AQUALIZER by Honeywell ASCa of North Vancouver, Canada. The disclosure of the '579 patent is incorporated herein by reference. An array of nozzles is mounted in a spray boom that extends across the sheet in the cross direction. FIG. 4 is a cross-section view through a spray boom 50 showing the details of an exemplary nozzle actuator. Each nozzle assembly 52 comprises a housing 51 having an air inlet 54 for connection to an air pressure source 56, a liquid inlet 58 for connection to a liquid source 60, and a nozzle outlet 62. Nozzle outlet delivers atomized water 64 to paper sheet 8 in a spray pattern that defines the footprint of the nozzle actuator. In the illustrated arrangement, the cross-direction shape of the spray pattern can be manipulated by adjusting the air pressure or air flow delivered to the nozzle via air supply 56.

Figure 5:
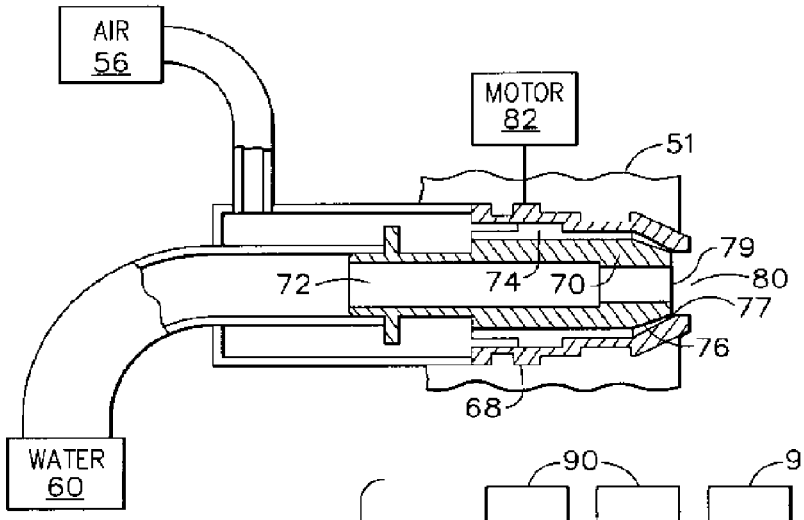
FIG. 5 is a detail view of the water spray nozzle employed in the actuator of FIG. 4.

FIG. 5 provides a detail cross-section view through housing 51 of the water spray nozzle described in U.S. Pat. No. 6,334,579. The nozzle includes an outer casing 68 into which is introduced an insert 70. Water under pressure from supply line 60 is delivered to a central liquid passage 72 through insert 70. Pressurized air from air supply 56 is delivered to an annular air passage 74 created between insert 70 and outer casing 68. The outer surface of insert 70 is formed with a plurality of channels in a spiral configuration that terminate adjacent the tip 76 of the insert. The spiral channels act to swirl a portion of the air travelling through annular air passage 74 immediately adjacent the insert while the remainder of the air flow maintains a linear flow pattern through the passage. The air passage and the liquid passage terminate, respectively, at an air discharge opening 77 and a water discharge opening 79 in a common atomization zone 80 at nozzle outlet 62 where liquid flowing through the liquid passage is atomized into a consistent spray pattern with good water atomization over a wide range of water flow rates. The water flow rate is adjusted via a first control action to modify the magnitude of nozzle actuator response by virtue of varying the volume of water delivered to the sheet. In order to adjust the shape of the spray pattern, the system of the present invention provides an actuator associated with each nozzle to permit adjustment in the position of water discharge opening 79 with respect to air discharge opening 77. In the illustrated embodiment, this is accomplished by way of a motor 82 that acts to move nozzle insert 70 within outer casing 68. In other words, the second control action to modify the shape of the spray pattern for the illustrated nozzle involves sending a signal to motor 82 to adjust the position of the insert 70 within casing 68. In general, if water pressure and air pressure are maintained constant, forward movement of nozzle insert 70 with respect to outer casing 69 will tend to result in a spray pattern of smaller diameter at the sheet under manufacture while rearward movement of the nozzle insert will result in a spray pattern of larger diameter.

In the case of the calendering section of a paper-making machine, where the paper sheet passes between rolls to adjust the thickness (caliper) of the paper, the nip or gap between adjacent rolls can be controlled by induction heating coil actuators. The heating coil actuators heat control zones on one or more of the rolls to increase the diameter of the rolls within each zone and thereby decrease the gap between the rolls. This system establishes a gap profile in the cross direction which is imparted to a paper sheet fed between rolls. By way of example, U.S. Pat. No. 4,384,514, entitled NIP CONTROL METHOD AND APPARATUS, discloses an example of such an induction heating apparatus which is sold under the trademark Calcoil by Honeywell ASCa of North Vancouver, Canada.

Figure 6:
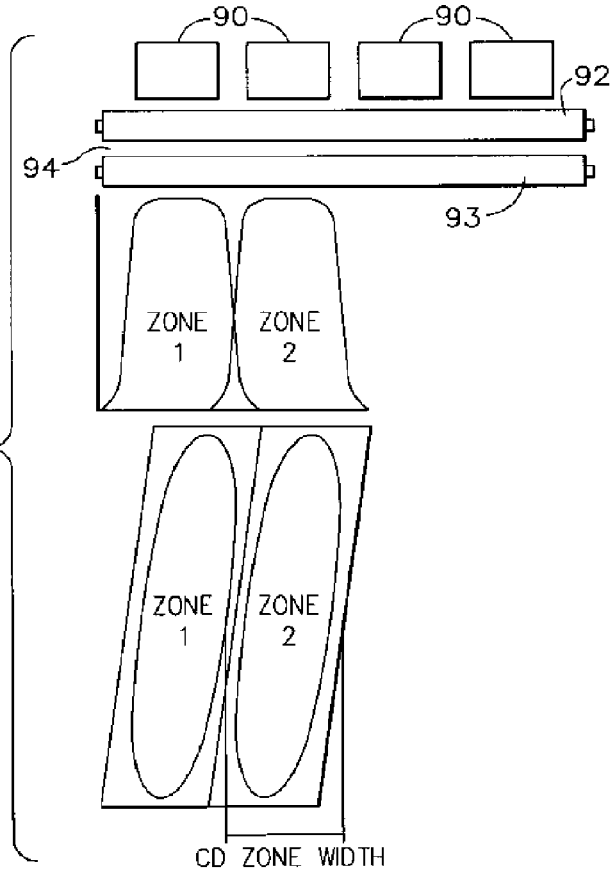
FIG. 6 is a schematic view of an induction heating coil actuator according to the present invention for use at the press or calendaring section of a paper-making machine.

Referring to FIG. 6, there is shown schematically, a plurality of induction heating coil actuators 90 which are arranged in the cross machine direction adjacent a nip roll 92 of a pair of rolls 92, 93 in the calendering section of a paper-making machine. As is conventional, induction heating coil actuators 90 are activated to heat the exterior of nip roll 92 to induce a local change in diameter of the roll within a zone or control "slice" influenced by each heating coil. The local change in diameter of the nip roll 92 results in a local change in the dimensions of the gap 94 between the rolls. The thickness of the sheet material that is fed between the rolls will be affected depending on the dimensions of gap profile.

In the arrangement of the present invention, each induction heating coil is mounted for pivotable movement. As is conventional, the first control action according to the present invention involves adjusting the current to the coils to cause induction heating that produces a desired increase in the diameter of the nip roll 92. The second control action to adjust the cross-direction shape of the actuator control slice comprises adjusting the angle of the heating coil which affects the shape of the control slice at the nip roll 92.

Figure 6A:
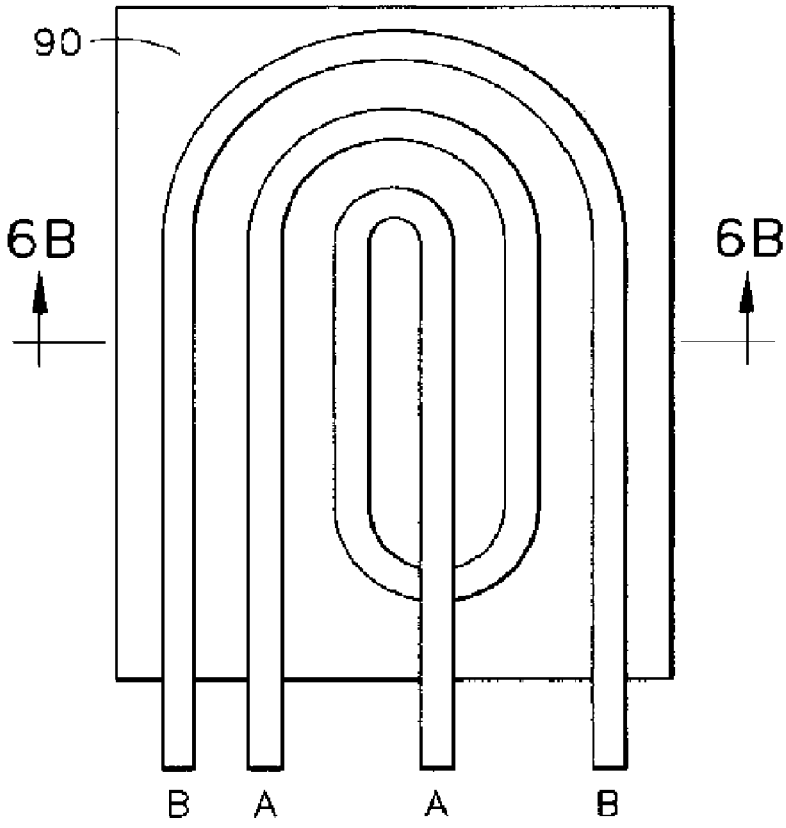
FIG. 6A illustrates a cross-section through an induction heating coil actuator according to another embodiment of the present invention.
Figure 6B:
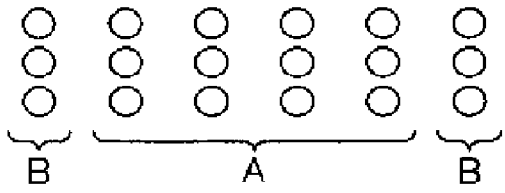
FIG. 6B is a view taken along line 6B—6B of FIG. 6A showing individual wires of the windings.

Alternatively, the induction heating coils of the present invention can be formed with multiple windings for generating different magnetic field geometries. The second control action to manipulate the cross-direction shape of the actuator control action comprises controlling the current in an appropriate winding to create a control slice of the desired shape. For example, FIG. 6A illustrates a cross-section through an induction heating coil actuator 90, which includes windings A and B. FIG. 6B is a view taken along line 6B—6B of FIG. 6A showing individual wires of the windings arranged in groups by virtue of the configuration of the coil windings. If current is delivered to the wires of both windings A and B, it is apparent actuator 90 will have a magnetic field footprint of maximum extent that includes the contribution of both groups of wires. Alternatively, if current is delivered to only one winding, the magnetic field footprint of the actuator will be reduced in size. Furthermore, changing the footprint is not limited to delivering or not delivering current to a particular winding. It is also possible to vary the amount of the current delivered to each winding to vary the footprint. For example, winding A can receive a different current from that delivered to winding B to adjust the magnetic field footprint of the actuator.

Figure 7:
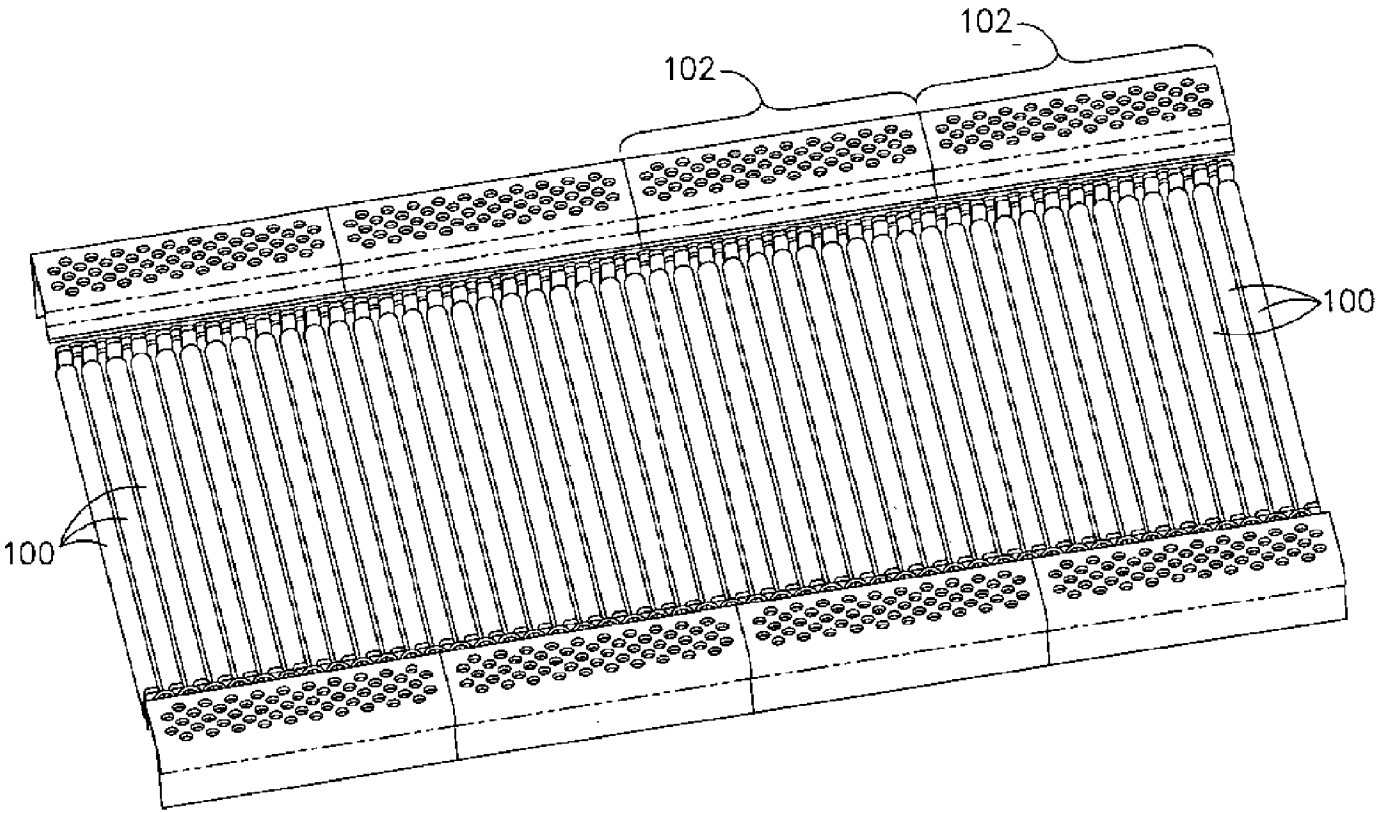
FIG. 7 is a schematic view of an electric infrared heating actuator for the present invention.

Moisture can be removed from the paper sheet under manufacture using an infrared heating actuator comprising a series of infrared heating lamps. An example of such an infrared heating apparatus is sold under the trademark INFRATROL by Honeywell ASCa of North Vancouver, Canada. FIG. 7 illustrates an example of an infrared heating actuator, which comprises a series of elongate infrared heating lamps 100 mounted between a ceramic backing and a protective quartz plate. In the illustrated example, each infrared lamp 100 comprises a 2 kW bulb, and twelve bulbs define a control zone 102 that is six inches wide in the cross-machine direction. In the arrangement of the present invention, the first control action comprises setting a base or average voltage for all the lamps in a zone 102 to create an appropriate heating action. This can be achieved by adjusting the applied voltage to the lamps or by applying the power in a duty cycle to the lamps. The second control action for manipulating the cross-direction shape of each control zone comprises controlling the voltage of each individual heating lamp to adjust the control zone dimensions. For example, the outermost lamps in a control zone may be set to a lower voltage or a different power duty cycle to reduce the effective footprint of the control action. The voltage to lamps in different, but adjacent control zones may be co-ordinated to enlarge the control zone footprint or to shift the footprint in a desired direction. For example, one or more lamps at one side of a first control zone may be operated at the same voltage as the lamps in a second, adjacent control zone to effectively increase the footprint of the second control zone. Similarly, one or more lamps at each side of a middle control zone may be operated at voltages corresponding to the lamps of adjacent control zones on either side of the middle zone to effectively shift the footprints of the control zones in the cross-machine direction.

Moisture can also be removed from the paper sheet under manufacture using actuators in the form a series of independently controllable gas-fired infrared matrix emitters that are positioned over the paper web in the cross-machine direction. By way of example, commonly owned United States Patent No. (currently allowed application Ser. No. 09/775,391) entitled INFRARED HEATER discloses an example of such an infrared heating matrix, which is sold under the trademark INFRAZONE by Honeywell ASCa of North Vancouver, Canada. The disclosure of the '391 application is incorporated herein by reference.

Figure 8:
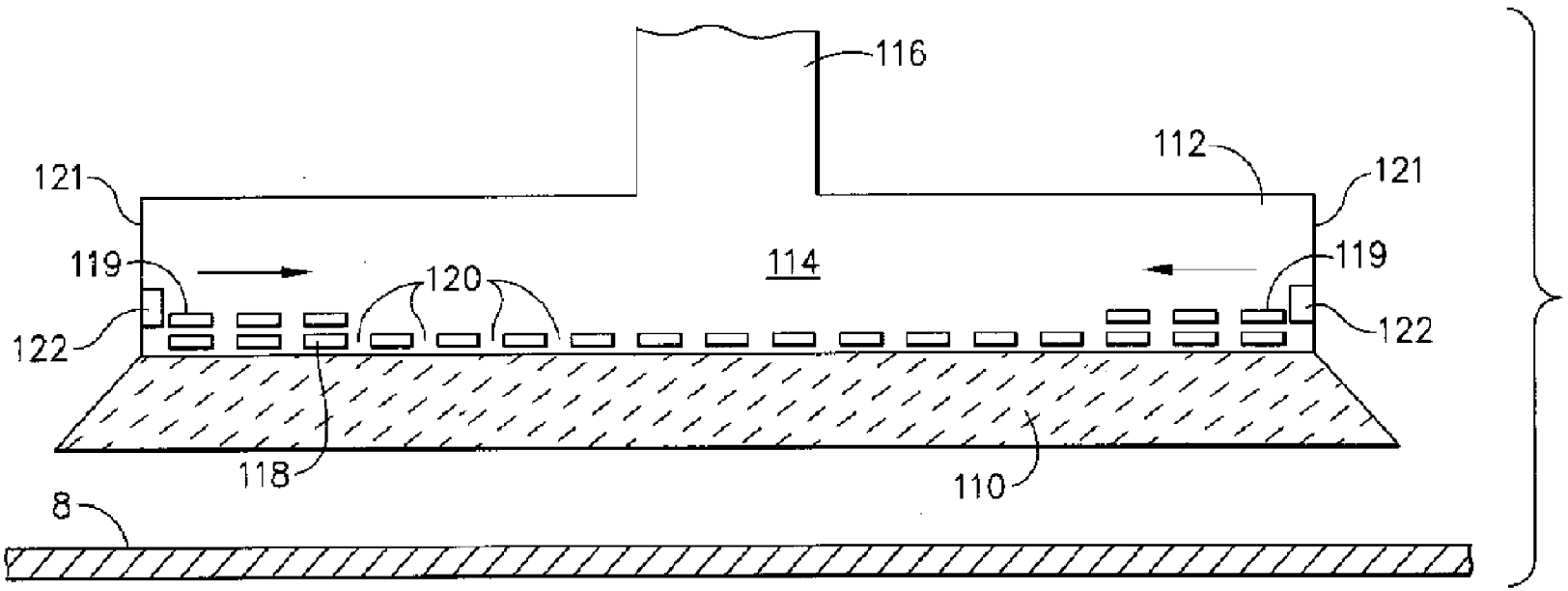
FIG. 8 is a cross-section view through a gas infrared emitter heating actuator designed to permit adjustment of the footprint shape of the actuator by virtue of movable screens.

Referring to FIG. 8, there is shown a cross-section view through a gas-fired infrared matrix emitter actuator according to the present invention. Each gas-fired infrared matrix emitter actuator comprises a porous refractory ceramic matrix 110 that is fitted into a metallic housing 112. A plurality of housings is positioned side by side to extend across the web adjacent a sheet 8 under manufacture. The porous ceramic matrix is bonded to the housing with silicone to define a plenum chamber 114. The plenum chamber of the housing is supplied with an air/fuel mixture via an inlet 116 that connects to a fuel supply (not shown). Gaseous fuel in the form of natural gas or propane is mixed with air according to a stoichiometric ratio, which is preferably about 1:10 to create the air/fuel mixture. Combustion occurs only on the outer 1 mm of the ceramic matrix to provide fast heatup times of about five seconds and fast cooldown times of about one second. This behaviour is essentially due to the ability of infrared emitting particles incorporated in the matrix 110 to radiate the heat generated, thus preventing the combustion flames from destroying the matrix by melting.

In the present invention, each matrix emitter actuator includes screen plates 118, 119 with openings 120 therethrough adjacent emitter matrix 110. Main screen plate 118 is fixed in position within the plenum chamber 114 while smaller, movable screen plates 119 are positioned at opposite ends of the chamber. Screen plates 119 are movable by control motors 122 with respect to main screen plate 118 to fully or partially align or misalign openings 120 in the plates. In this arrangement, the second control action for manipulating the shape of the actuator footprint involves controlling the position of screens 119 to control the gas supply to the emitter matrix. In the illustrated embodiment, movable screens 119 are positioned adjacent the end walls 121 of housing 112 with openings aligned with the openings in fixed main screen 118. In this configuration, the air/fuel mixture is free to disperse across the full extent of the emitter matrix 110 to obtain the maximum size of the control footprint. If movable screens 119 are moved inwardly away from side walls 121 by motors 122, the openings in the screens will misalign to reduce the size of the control footprint of the actuator as the gas/fuel mixture is prevented from reaching the outer edges of the emitter matrix.

From the above, it may be appreciated that enhanced control is provided due to the various approaches described above. The description is continued with a flow-chart summarizing some of the features described above.

Figure 9:
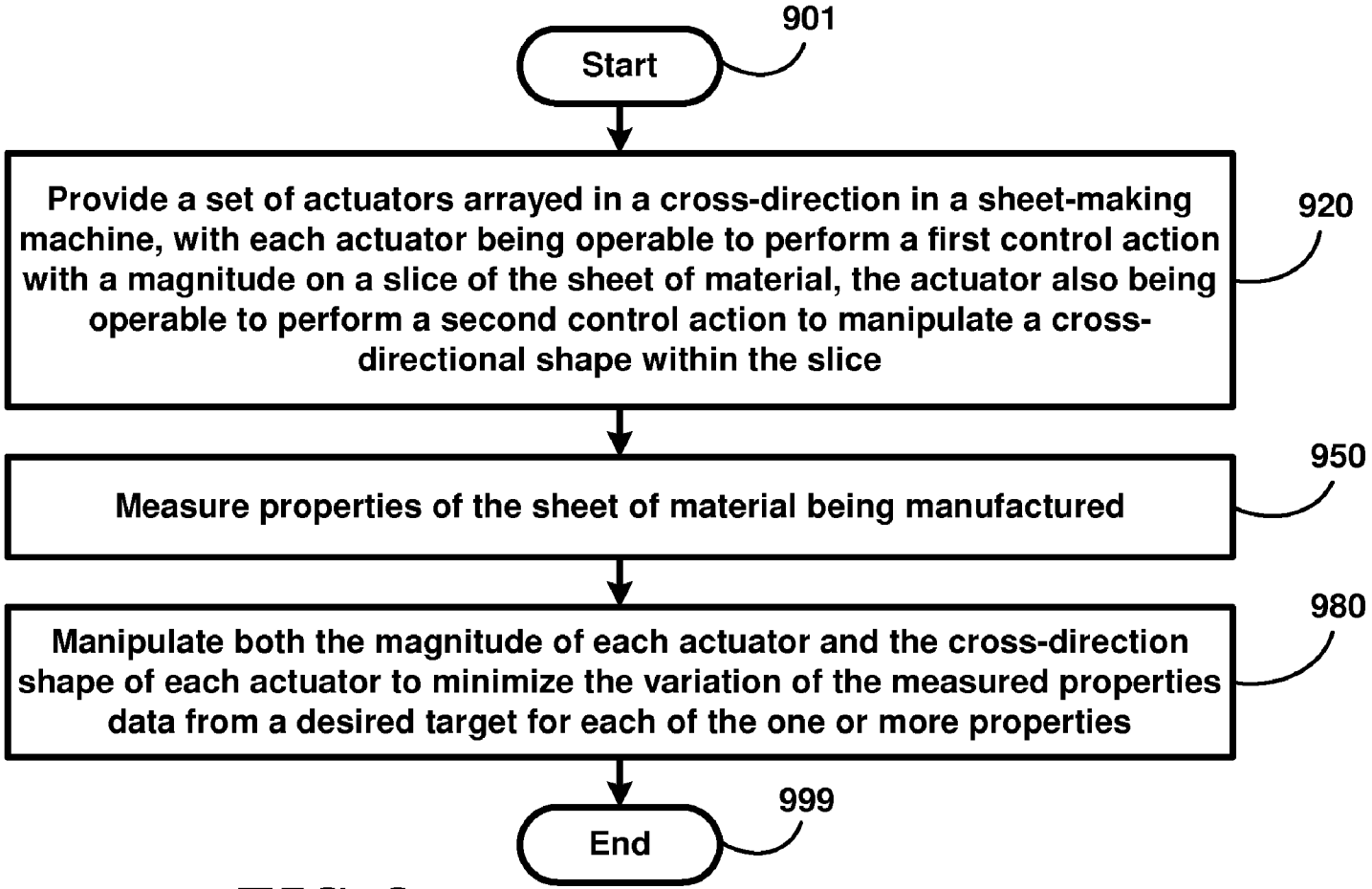
FIG. 9 is a flowchart illustrating the manner in which the properties of a sheet of material is controlled according to an aspect of the present invention.

FIG. 9 is a flowchart illustrating the manner in which one or more properties of a sheet of material is controlled according to an aspect of the present invention. The flowchart begins in step 901, wherein control immediately passes to step 920.

In step 920, a set of actuators are provided arrayed in a cross-direction in a sheet-making machine, with each actuator being operable to perform a first control action with a magnitude on a slice of the sheet of material, the actuator also being operable to perform a second control action to manipulate a cross-directional shape within the slice.

In step 950, properties of the sheet of material being manufactured are measured. In step 980, both the magnitude of each actuator and the cross-direction shape of each actuator are manipulated to minimize the variation of the measured properties data from a desired target for each of the properties. The flowchart ends in step 999.

Thus, enhanced control is provided by manipulating the magnitude and the cross-directional shape of each actuator based on the variation of the measured properties data from a desired target. The manner in which the properties data are measured and the control signals correspondingly calculated is described in detail below.

Figure 10:
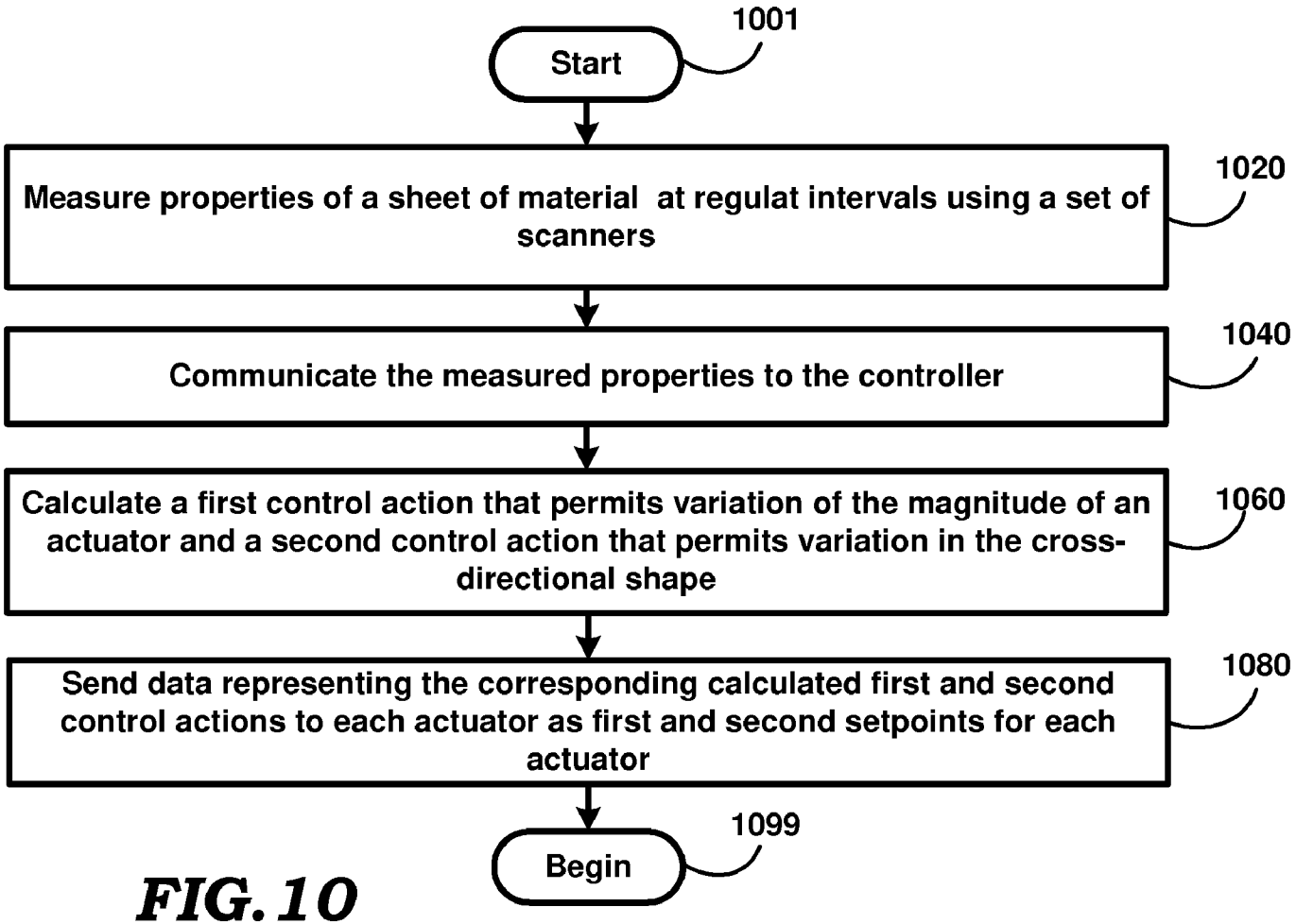
FIG. 10 is a flowchart illustrating the manner in which the control actions to be sent to actuators for controlling the properties of a sheet of material is calculated by a controller in an embodiment of the present invention.

FIG. 10 is a flowchart illustrating the manner in which the control actions to be sent to actuators for controlling the properties of a sheet of material is calculated by a controller in an embodiment of the present invention. The flowchart begins in step 1001, in which control immediately passes to step 1020.

In step 1020, properties of a sheet of material are measured, for example, at regular intervals using a set of scanners. In step 1040, the measured properties are communicated to a controller. In step 1060, the controller calculates a first control action that permits variation of the magnitude of an actuator and a second control action that permits variation in the cross-directional shape.

In step 1080, data representing the corresponding calculated first and second control actions to each actuator is sent as first and second setpoints for each actuator. The flowchart ends in step 1099.

As described in sections above, the data sent by the controller enable each actuator to perform a first control action with a magnitude on a slice of said sheet of material, and also to perform a second control action to manipulate a cross-directional shape within the slice.

Although the present invention has been described in some detail by way of example for purposes of clarity and understanding, it will be apparent that certain changes and modifications may be practised within the scope of the appended claims.

What is claimed is:

1. A method for controlling one or more properties of a sheet of material to be manufactured on a sheet-making machine, said method comprising the steps of:

providing a plurality of actuators arrayed in a cross-direction in said sheet making machine, with each actuator being operable to perform a first control action with a magnitude on a slice of said sheet of material, the actuator also being operable to perform a second control action to manipulate a cross-directional shape within said slice;

measuring properties data about the one or more properties of the sheet of material; and manipulating both said magnitude of each actuator and said cross-direction shape of each actuator to minimize the variation of the measured properties data from a desired target for each of the one or more properties.

2. The method as claimed in claim 1 in which the step of measuring properties data is done by a plurality of scanners.

3. The method as claimed in claim 1 including the step of communicating the measured properties data to a controller.

4. The method as claimed in claim 3 including the step of calculating the control actions at the controller to communicate to each of the actuators.

5. The method as claimed in claim 4 in which the step of measuring properties data is performed at regular intervals to provide feedback to the controller with respect to previous control actions.

6. The method as claimed in claim 5 in which the step of calculating control actions involves calculating said first control action that permits variation of said magnitude of an actuator and said second control action that permits variation in said cross-directional shape of said actuator.

7. The method as claimed in claim 6 in which data representing the corresponding calculated first and second control actions are communicated to each actuator as first and second setpoints for each actuator.

8. The method as claimed in claim 6 in which the step of calculating control actions is performed taking into account actuator characteristics.

9. The method as claimed in claim 6 in which the step of calculating said data related to control actions is performed taking into account sheet characteristics.

10. The method as claimed in claim 1 in which each actuator comprises a steam actuator having an outlet chamber for releasing steam to the sheet of material, and the step of manipulating the cross direction shape of each actuator comprises manipulating the cross-direction position and dimensions of the outlet chamber.

11. The method as claimed in claim 10 in which the outlet chamber includes at least one movable baffle plate within the outlet chamber, and manipulating the cross-direction position and dimensions of the outlet chamber comprises moving the at least one movable baffle plate.

12. The method as claimed in claim 1 in which each actuator comprises a steam actuator having an outlet chamber for releasing steam to the sheet of material including a screen plate with openings there through covering the outlet chamber and at least one movable plate, and the step of manipulating the cross-direction shape of each actuator comprises moving the at least one movable plate with respect to the screen plate to fully or partially obstruct the openings in the screen plate.

13. The method as claimed in claim 1 in which each actuator comprises a steam actuator having an outlet chamber for releasing steam to the sheet of material including at least one air jet associated with the outlet chamber, and the step of manipulating the cross-direction shape of each actuator comprises discharging the air jets to control the steam dispersal.

14. The method of claim 1 in which each actuator comprises a nozzle for delivering water atomized by air pressure to the sheet of material, and the step of manipulating the cross-direction shape of each actuator comprises adjusting the air pressure at the nozzle.

15. The method of claim 1 in which each actuator comprises a nozzle for delivering water atomized by air pressure to the sheet of material, and the step of manipulating the cross-direction shape of each actuator comprises adjusting the air flow at the nozzle.

16. The method of claim 1 in which each actuator comprises a nozzle for delivering water atomized by air pressure to the sheet of material, and the step of manipulating the cross-direction shape of each actuator comprises adjusting the position of a water discharge opening of the nozzle with respect to an air discharge opening of the nozzle.

17. The method of claim 1 in which each actuator comprises an induction heating coil for heating at least one of a pair of rolls to change the diameter of the at least one roll in order to vary the gap between the pair of rolls and thereby the thickness of a sheet of material passing between the rolls with each heating coil having multiple windings for generating magnetic fields, and the step of manipulating the cross-direction shape of each actuator comprises controlling the current to the windings.

18. The method of claim 1 in which each actuator comprises an induction heating coil for heating at least one of a pair of rolls to change the diameter of the at least one roll in order to vary the gap between the pair of rolls and thereby the thickness of a sheet of material passing between the rolls with each heating coil being mounted for pivotable movement, and the step of manipulating the cross-direction shape of each actuator comprises adjusting the angle of the heating coil.

19. The method of claim 1 in which each actuator comprises an array of infrared heating lamps for heating the sheet of material, and the step of manipulating the cross-direction shape of each actuator comprises controlling the voltage of each heating lamp.

20. The method of claim 1 in which each actuator comprises a gas-fired infrared emitter matrix for generating infrared radiation to heat the sheet of material, the emitter matrix being heated by combusting gas and having screen plates with openings there through adjacent the emitter matrix, and the step of manipulating the cross-direction shape of each actuator comprises moving the screen plates with respect to each other to fully or partially align or misalign openings in the screen plates thereby controlling the gas supply to the emitter matrix.

21. The method as claimed in claim 1 in which each actuator comprises a motor for controlling the position of a slice lip mounted to a head box, and the step of manipulating the cross direction shape of each actuator comprises manipulating the global position of the slice lip.

* * * * *